US009646429B2

(12) United States Patent
Rousu et al.

(10) Patent No.: US 9,646,429 B2
(45) Date of Patent: May 9, 2017

(54) APPARATUS, METHODS AND COMPUTER PROGRAM PRODUCT FOR THERMAL MANAGEMENT OF USER EQUIPMENT COUPLED TO A VEHICLE

(71) Applicant: Avago Technologies General IP (Singapore) Pte. Ltd., Singapore (SG)

(72) Inventors: Seppo Rousu, Oulu (FI); Timo Juntunen, Kempele (FI)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 13 days.

(21) Appl. No.: 14/084,800

(22) Filed: Nov. 20, 2013

(65) Prior Publication Data

US 2014/0163814 A1 Jun. 12, 2014

(30) Foreign Application Priority Data

Dec. 12, 2012 (GB) ..... 1222394.7

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01)

(58) Field of Classification Search
CPC ..... G05D 23/1905; G05D 23/1917; G05D 23/1927; H04L 41/0813; H04L 41/0893; G07C 5/008; G07C 5/0808
USPC ..... 701/33.9; 700/299
See application file for complete search history.

(56) References Cited

U.S. PATENT DOCUMENTS 5,815,071 A * 9/1998 Doyle ..... B60K 31/0058 340/12.25
6,145,098 A * 11/2000 Nouri ..... G06F 1/20 714/31
8,086,229 B2 * 12/2011 Lindoff et al. ..... 455/423
2006/0220806 A1 * 10/2006 Nguyen ..... B60R 25/102 340/426.36
2008/0046132 A1 * 2/2008 Dalsgaard et al. ..... 700/299
2009/0088187 A1 * 4/2009 Krause ..... H04L 12/5895 455/466
2010/0091747 A1 * 4/2010 Dorsey ..... H04B 1/036 370/338

(Continued)

FOREIGN PATENT DOCUMENTS

EP 0876070 A1 * 11/1998 ..... H04M 19/041
JP EP 1143627 A1 * 10/2001 ..... H04B 1/036

OTHER PUBLICATIONS

"Threshold", CollinsDictionary.com, The Collins English Dictionary Online, 2011.*

(Continued)

*Primary Examiner* — John Q Nguyen
*Assistant Examiner* — Nadeem Odeh
(74) *Attorney, Agent, or Firm* — Foley & Lardner LLP

(57) ABSTRACT

Apparatus, a method and a computer program product periodically determine one or more temperature thresholds and configuration settings attributable to one or more user equipment coupled to a vehicle. The one or more determined temperature thresholds and configuration settings are sent to the one or more user equipment in a thermal management scheme message. The one or more user equipment are adapted to adjust an operational threshold in response to the received thermal management scheme message.

20 Claims, 6 Drawing Sheets

(56) References Cited

U.S. PATENT DOCUMENTS

2015/0000889 A1* 1/2015 Bellamkonda ..... G01K 7/42
165/287

OTHER PUBLICATIONS

Intellectual Property Office of UK, Search Report for GB1222394.7, Jun. 20, 2013, United Kingdom Intellectual Property Office.*

* cited by examiner

APPARATUS, METHODS AND COMPUTER PROGRAM PRODUCT FOR THERMAL MANAGEMENT OF USER EQUIPMENT COUPLED TO A VEHICLE

CROSS REFERENCE TO RELATED APPLICATION

This application claims the benefit under 35 U.S.C. §119 (a) and 37 CFR §135 to UK Patent Application No, 1222394.7, filed on Dec. 12, 2012, the entire content of which is incorporated herein by reference.

FIELD OF THE INVENTION

The present invention relates to apparatus, methods and computer program products for thermal management of user equipment coupled to a vehicle. The example and non-limiting embodiments of this invention relate generally to wireless communication systems, methods, devices and computer program products, and specific examples relate to dynamically adjusting temperature thresholds and decision making rules for thermal management of one or more user equipment coupled to a vehicle.

BACKGROUND INFORMATION

Increasingly, motor vehicles are becoming equipped with wireless communication devices (hereinafter "user equipment") to allow various advanced capabilities coordinated by way of remote computer networks. For example, user equipment allow remote monitoring of vehicle maintenance and performance as well as enabling roadside assistance, together with map rendering programs, by way of global positioning satellite services or network positioning or the like. In yet another example, user equipment is coupled in vehicles to allow cellular phone service by integrating user equipment into telematics display consoles or in the ceiling/roof of the vehicle. Other services provided by user equipment include access to social media programs, entertainment, e-mail or Internet browsing over IP networks by way of WiFi or advanced cellular networks, such as Long Term Evolution (LTE) and LTE-Advanced (LTE-A). Still other user equipment coupled in motor vehicles allow for fleet operations or enable ad hoc networks for large fleets of commercial delivery trucks, rental vehicles or other grouped or classified vehicles. In the near future, motor vehicles utilized by first responder vehicles (e.g. police, fire, public safety and emergency medical technician vehicles) in at least the United States will be equipped with user equipment operating in the 700 frequency D-block band to access the First Responder Network Authority (FirstNet) which will have architecture similar to LTE.

The environment and operational lifetimes of user equipment coupled to motor vehicles are unlike traditional user equipment such as cellular telephones, tablets and laptop computers. For example, design requirements of a particular motor vehicle may require that radio frequency (RE) circuits (RFICs, power amplifiers, frequency generation, crystals, active/passive frequency selective components, switches as discrete or modules or system in package (SIP)) are integrated into the vehicle's telematics console, on board diagnostic (OBD) interface, ceiling or steering wheel assembly, among other internal cabin locations. Alternatively, SIP, RF circuits and the RFICs may be integrated into modules outside the vehicle chassis. As such, thermal management of user equipment over the products' lifetime can be problematic.

SUMMARY

According to a first aspect of the present invention, there is provided a method including periodically determining one or more temperature thresholds and configuration settings attributable to one or more user equipment coupled to a vehicle, and sending the one or more determined temperature thresholds and configuration settings to the one or more user equipment in a thermal management scheme message, wherein the one or more user equipment are adapted to adjust an operational threshold in response to the received thermal management scheme message.

According to a second aspect of the present invention, there is provided apparatus arranged to at least periodically determine one or more temperature thresholds and configuration settings attributable to one or more user equipment coupled to a vehicle, and sends the one or more determined temperature thresholds and configuration settings to the one or more user equipment in a thermal management scheme message, whereby the one or more user equipment can adjust an operational threshold in response to the received thermal management scheme message.

According to a third aspect of the present invention, there is provided a computer program product including instructions for causing performance of operations, said operations including: periodically determining one or more temperature thresholds and configuration settings attributable to one or more user equipment coupled to a vehicle, and sending the one or more determined temperature thresholds and configuration settings to the one or more user equipment in a thermal management scheme message, whereby the one or more user equipment can adjust an operational threshold in response to the received thermal management scheme message.

According to a fourth aspect of the present invention, there is provided apparatus including means for periodically determining one or more temperature thresholds and configuration settings attributable to one or more user equipment coupled to a vehicle, and a means for sending the one or more determined temperature thresholds and configuration settings to the one or more user equipment in a thermal management scheme message, whereby the one or more user equipment can adjust an operational threshold in response to the received thermal management scheme message.

According to a fifth aspect of the present invention, there is provided a method including periodically receiving a thermal management scheme message based upon a predetermined temperature threshold and configuration setting attributable to one or more user equipment coupled to a vehicle and adaptively adjusting an operational threshold in response to the received thermal management scheme message.

According to a sixth aspect of the present invention, there is provided apparatus, the apparatus being arranged to at least periodically receive a thermal management scheme message based upon a predetermined temperature threshold and configuration setting attributable to one or more user equipment coupled to a vehicle and adaptively adjusting an operational threshold in response to the received thermal management scheme message.

According to a seventh aspect of the present invention, there is provided a computer program product including instructions for causing performance of operations, said operations including: periodically receiving a thermal management scheme message based upon a predetermined temperature threshold and configuration setting attributable to one or more user equipment coupled to a vehicle and adaptively adjusting an operational threshold in response to the received thermal management scheme message.

According to an eighth aspect of the present invention, there is provided apparatus including means for periodically receiving a thermal management scheme message based upon a predetermined temperature threshold and configuration setting attributable to one or more user equipment coupled to a vehicle, and means for adaptively adjusting an operational threshold in response to the received thermal management scheme message.

The apparatus described above may include at least one processor and at least one memory which stores a computer program, the at least one memory with the computer program being configured with the at least one processor to cause the apparatus to at least operate as described above.

There may be provided a computer readable memory which stores a computer program as described above (computer program product), in which the computer program causes a machine to operate as described above.

Further features and advantages of the invention will become apparent from the following description of preferred embodiments of the invention, given by way of example only, which is made with reference to the accompanying drawings.

DETAILED DESCRIPTION

Figure 1:
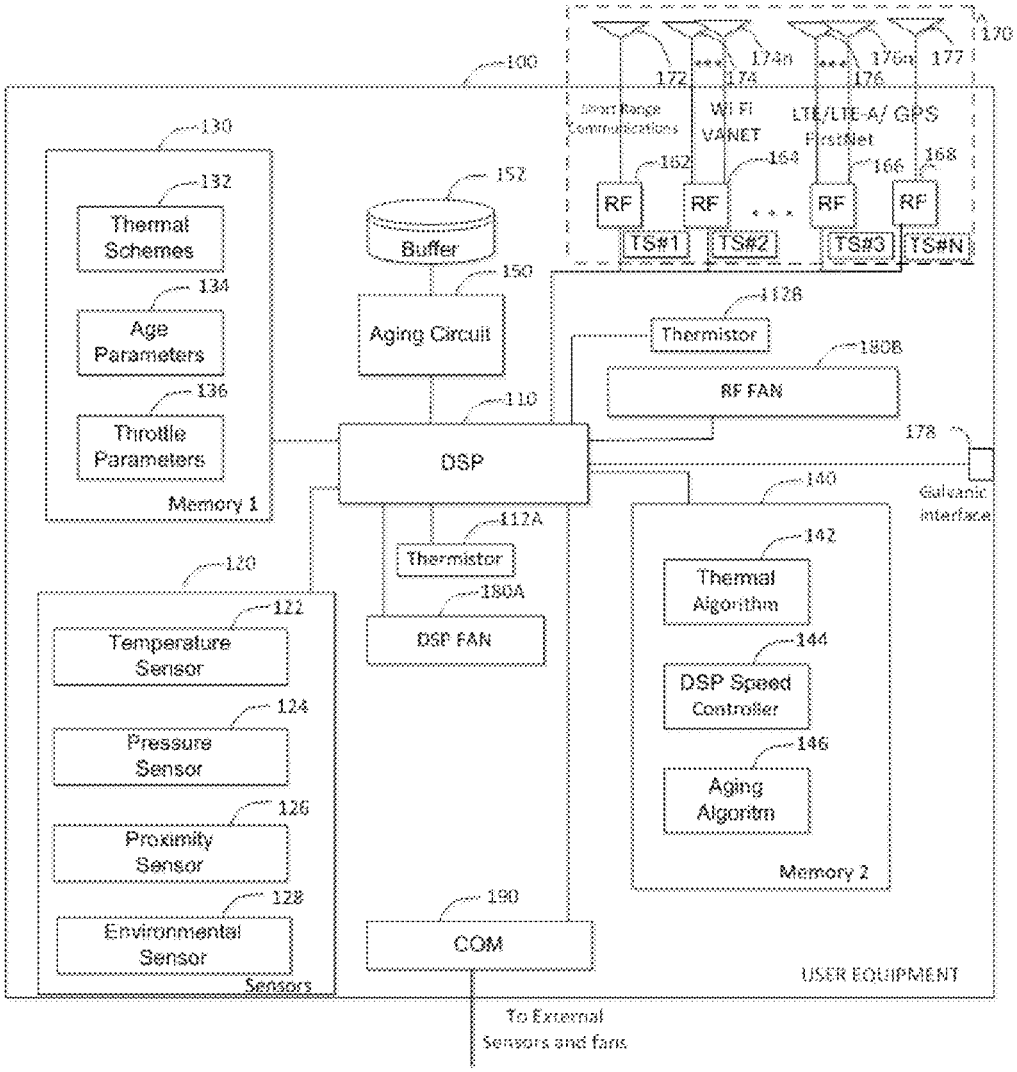
FIG. 1 shows a simplified block diagram of an example of a user equipment coupled to a vehicle suitable for use in practicing some example embodiments of the invention.

The example embodiments of this invention provide apparatus, methods, and computer program products that periodically determine one or more temperature thresholds and configuration settings attributable to one or more user equipment coupled to a motor vehicle which then send the one or more determined temperature thresholds and configuration settings to the one or more user equipment in a thermal management scheme message. The one or more user equipment are adapted to adjust an operational threshold in response to the received thermal management scheme message. In one example embodiment, a specialized network or a specialized network server is employed to determine temperature thresholds and configuration settings and then send that message to the one or more user equipment in the thermal management scheme message. In another example embodiment, one or more user equipment receives the thermal management scheme message based upon a predetermined temperature threshold and configuration setting attributable to one or more user equipment coupled to a vehicle, and adaptively adjusts an operational threshold in response to the received thermal management scheme message.

Increasingly, user equipment is being integrated into existing onboard diagnostic interfaces (OBD), the telematics console of a motor vehicle, or coupled to the vehicle, such as installed on the roof in a specialized module, installed inside the ceiling of the vehicle's cabin, or installed in the vehicle's dashboard or steering assembly as any assembly part or after sales part of a vehicle. Typically, the same types of components are used in different user equipment. For example, radio frequency components, modules, circuits and RF integrated circuits (RFICs) are increasingly being introduced in different kinds of user equipment. In terms of thermal management of user equipment, each installation point involves a trade off between user experience and product reliability. That is, extended temperature thresholds allow data communication over a radio link of the user equipment to last longer, but with a trade off of reliability.

Various thermal ranges are required to be supported for user equipment. For example, Third Generation Partnership Program (3GPP) TS 36.101 requires that user equipment make effective use of radio frequency spectrum between +15° C. to +35° C. under "normal conditions" (with relative humidity of 25% to 75%) and between −10° C. to +55° C. under "extreme conditions" (e.g. cold or dry heat). Likely, user equipment coupled to or integrated into first responder and public safety motor vehicles may require effective use of the radio frequency spectrum for even more extreme conditions than that specified by 3GPP, as will likely be defined in the future by the first responder authority network and/or public safety authority network in the United States and/or elsewhere.

As alluded to above, each installation point requires different operational environmental temperatures. That is, user equipment installed in a motor vehicle roof or surface of a vehicle (e.g. integrated roof radio antenna module) will be subject to direct sunlight and precipitation, while user equipment integrated in an onboard diagnostic interface or telematics display will not. Also, the user equipment inside the motor vehicle cabin will be subject to the vehicle's environmental controls during normal operation and the roof installed user equipment will be subject to air flow while the motor vehicle is in motion.

Prior to describing the methods and operation of computer programs suitable for carrying out example embodiments of the present invention, one possible example of a user equipment will be described, followed by several example deployment scenarios.

Referring now to FIG. 1, an illustration of a simplified block diagram of an example of a user equipment (UE) 100 coupled to a vehicle suitable for use in practicing some example embodiments of the invention is shown. As mentioned above, non-limiting example embodiments of the present invention include coupling or installing a user equipment into existing onboard diagnostic interfaces (OBD), or a telematics console of a motor vehicle, or coupled to the vehicle such as installed on the roof in a specialized module, or inside the ceiling of the vehicle's cabin, or installed in the vehicle's dashboard or steering assembly or other suitable special purpose place.

As shown in FIG. 1, UE 100 includes one or more processors, such as at least one digital signal (DSP) 110, a first computer-readable memory 130, which stores a plurality of parameters such as thermal schemes 132, age parameters 134 and throttle parameters 136. The thermal scheme 132 includes a plurality of regional thermal profiles, each representing global regions of the world. For example, regional thermal profiles could represent specific known temperatures and barometric pressures by global regions according to calendar months, daylight and non-sunlight. Aging parameters 134 include specific data obtained from for example original design manufacturers (ODM) data sheets for user equipment or manufacturers of components, e.g. RFICs and module/system in package (SIP)/Modern on Module (MoM). Throttle parameters 136 include known processor speeds referenced to temperature ranges obtained from the processor manufacturers' data sheets. Furthermore throttle parameters 136 may include known data class and or downlink (DL) multiple input output (MIMO) data and/or uplink (UL) MIMO data class referenced to temperature ranges obtained from the manufacturers' data sheets. The parameters tangibly stored in the first computer-readable memory 130 are utilized by the computer programs stored in a second computer-readable memory 140. Such programs are adapted to implement the various thermal management schemes discussed in more detail below with regard to the methods of example embodiments of the present invention. For example, the second computer-readable memory 140 includes a thermal algorithm 142, a digital signal processor controller 144 and an aging algorithm 146.

UE 100 also includes a plurality of sensors 120, such as a temperature sensor 122, a pressure sensor 124, a proximity sensor 126 and an environmental sensor 128 or any special purpose sensor. Any sensor may be implemented as a discrete, functional module, as integrated functionality or as any special purpose embodiment. Each sensor can be integrated into UE 0.100, or can be integrated into existing sensors deployed in the host motor vehicle. Environmental sensors can include sensors for humidity, vibration, speed, precipitation, salinity, acceleration, sunlight and/or air flow.

One or more thermistors 112A, 112B are deployed in UE 100 to sense the heat developing proximate modem circuitry, application circuitry, DSP 110 or RF circuitry (radio frequency circuits) 162, 164 or 166. It should be noted that various additional components as known by those skilled in the art, such as power amplifiers, frequency generation, crystals, tunable/passive frequency selective components, switches as discrete or module/s or system in package (SIP), are omitted from FIG. 1 for the purpose of clarity. Also, as discussed in more detail below, one or more temperature sensors (e.g. TS#1, TS#2, TS#3 and TSN) can be proximally located or integrated into each RF circuit in an array of wireless transceivers 170 for directly sensing the temperature of each RF circuit (e.g. RF 162, RF 164, and RF 166). To control thermal properties inside the UE 100, one or more fans are preferably included, such as a DSP (digital signal processor) fan 180A and an RF fan 180B, each controlled by the thermal algorithm. Additional fans can be included in UE 100 and/or existing air flow management equipment in the motor vehicle cabin. In another embodiment, the thermal schemes 132 can periodically control the operation of the DSP fan 180A and the RF 180B fan based upon one or more regional thermal profiles.

Alternatively, the DSP speed controller 144, as well as the throttle parameters 136, can be invoked to reduce the number of carrier bs/modulation/power/speed of the DSP 110 and/or radio communication link in uplink or/and downlink. In one non-limiting example embodiment, DSP 110 operates in one or more operational modes, such as a limiting mode, a normal mode, and a boosting mode. Each of these one or more operational modes controls the operation of the one or more fans (e.g. DSP fan 180A and RF fan 180B) and the speed of the processor (e.g. DSP 110), predefined power levels of UE 100, uplink data speed, downlink data speed, data class, MIMO class and a number of communication links utilized by various programs employed by the user. Yet another mode includes an emergency mode which is adapted to allow UE 100 to operate independent of the thermal schemes. For example, a first responder vehicle may in certain situations be in communication with an emergency center. As such UE 100 may in that circumstance exceed any thermal schemes (e.g. a first responder vehicle responding to a fire). In one example embodiment. UE 100 can operate by user interaction. In yet another embodiment, the power input may have a connection to an extra battery for emergency communication. Such an emergency battery would provide power for UE 100 in the event that the main power feed fails. Moreover, the emergency battery may have a different power supply delivery capability than the normal mode battery.

Also, as shown in FIG. 1, an aging circuit 150 is included for periodically monitoring various components in UE 100, such as DSP 110 or RF circuitry/ies 162, 164, 166 or 168. As known in the art, such an aging circuit 150 can be one or more measuring circuits which receives a first output from each component (e.g. DSP 110 or RF circuitry 162, 164, 166 or 168) at a first duty cycle and receives a second output from the component operating at a duty cycle different from the first duty cycle. The first output and second output are stored in a buffer 152 divided in order to derive a standardized first output and second output. As such, the difference between the first output and the second output indicate the age of the circuit in accordance with known aging properties found, for example, in a manufacturer's data sheet.

Alternatively in some example embodiments an "aging circuit" is implemented in one or more memories (e.g. memory 1 (130) and/or memory 2 (140) in FIG. 1) and one or more processors (e.g. DSP 110) which are adapted to maintain a database containing various aging related data. For example, in one example embodiment, aging related data can include the number of times a predefined temperature threshold limit or ratio is exceeded. Such a threshold can be a single threshold limit or include multiple threshold limits. A ratio can be a calculated ratio between a 1st threshold limit and an alternate threshold limit. In another example embodiment, the aging related data can include a ratio of usage of different radio access technologies (RATs) by the user equipment over a predetermined product life time or other period of time. That is, the user equipment may over the course of its product life utilise different RATs such as 2G, 3G, LTE, LTE-A, WiFi or radio access devices which support connectivity to a VANET. As such this aging related data reflects the fact that different RATs impact components within the user equipment differently in such instances where RATs share common components. In another example embodiment, the aging related data include temperature information such as a delta Δ temperature representing a cycle between the beginning of a radio connection (e.g. starts from freeze)/peak temperature of radio connection. In yet another example embodiment, aging related data can include environmental temperature information; such information may include detailed information related to specific user demands on the user equipment and/or regional availability of access networks which combine affect the product life of the user equipment.

UE 100 includes wired and wireless interfaces, such as an array of wireless transceivers 170, a galvanic or wired interface 178 and a communication data port (COM) 190. The array of wireless transceivers 170 include RF circuits 162, 164, 166 or 168, each coupled directly or coupled indirectly be way of intervening components as known in the art to antennas/antenna systems adapted for example to provide multiple component carrier reception such as antennas 172, 174/174*n*, 176/176*n* and 177 respectively. Each transceiver is adapted for communicating on various radio access networks, such as a wireless local area network (WiFi), a vehicle ad-hoc network (VANET), a Long Term Evolution (LTE) or legacy cellular network, such as an Evolved Universal Terrestrial Radio Access Network, Universal Terrestrial Radio Access Network, a GSM Enhanced Data Rates for Global Evolution Radio Access Network, any special purpose network, a public safety network or a first responder network. Also, provided for determining the current location of the user equipment is a global position RF circuit 166 which is adapted for global navigation satellite system (GNSS). The wireless short range communication link can, for example, include a Bluetooth™ radio access interface (Bluetooth radio module), a Zigbee radio interface, a radio frequency identification (REED) interface, an IEEE 802.11e standardized radio interface, a near field communication link, or a communications access for land mobiles link, as well as other dedicated short range communications (DSRC) wireless technologies. Communication data port (COM) 190 can be a separate data link to external sensors and fans deployed in the motor vehicle cabin, or a link to the vehicle's maintenance data port. A vehicle's maintenance data port can be accessible by way of a compact disc (CD)/DVD player, USB flash memory stick, or other portable data memory stick, such as an SD or micro SD memory stick.

Also, a power regulator (not shown) is adapted for controlling one or more internal batteries (not shown) and/or external extra batteries (not shown) and to stabilize DC voltages used by the DSP 110 as well as and other components shown in FIG. 1.

Figure 2:
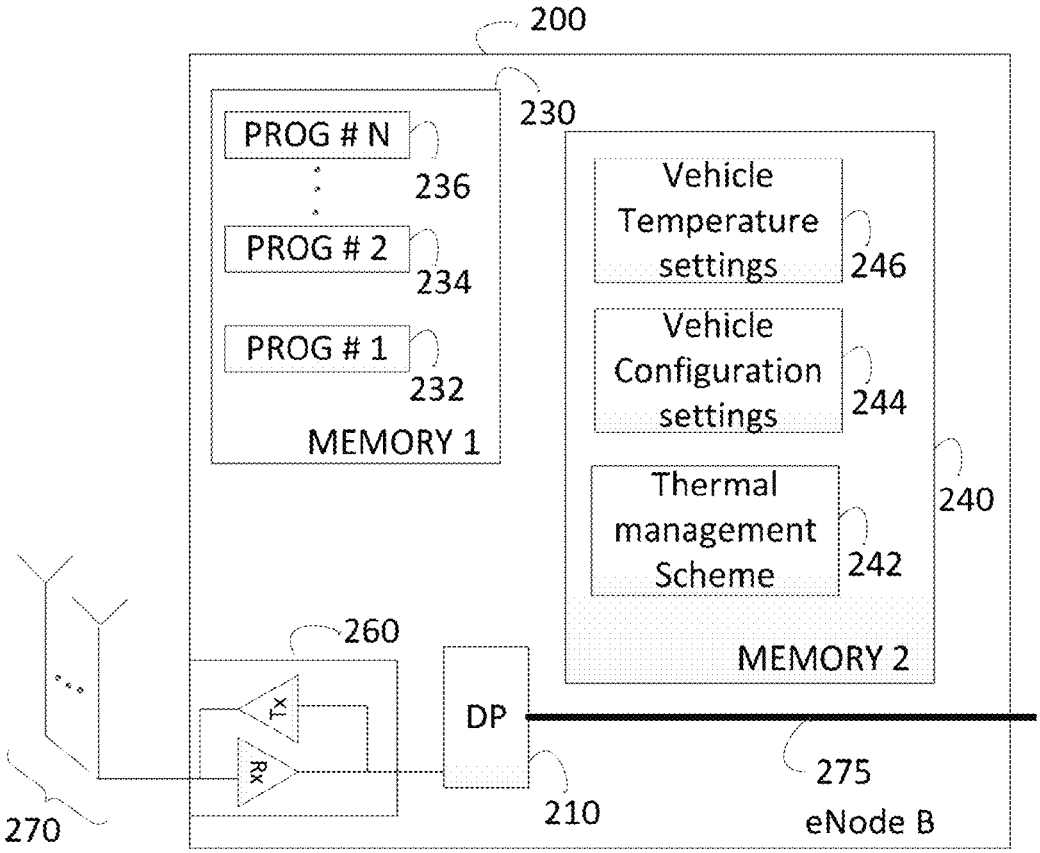
FIG. 2 shows a simplified block diagram of an example of an access point such as an evolved Node B suitable for use in practicing some example embodiments of the invention.

Referring now to FIG. 2, there is shown an illustration of a simplified block diagram of an example of an access point, such as an evolved Node B (eNB) 200, for use in practicing some example embodiments of the invention. As will be described in more detail below, example embodiments of the present invention provide methods and computer programs which periodically determine one or more temperature thresholds and configuration settings attributable to one or more user equipment coupled to a vehicle and send the one or more determined temperature thresholds and configuration settings to the one or more user equipment in a thermal management scheme message. Thereafter, the one or more user equipment (such as UE 100 above) are adapted to adjust an operational threshold in response to the received thermal management scheme message. In one example embodiment of the present invention, eNB 200 is adapted to provide the above described functionality.

eNB 200 includes one or more processors, such as at least one data processor (DP) 210, a first computer-readable memory 230 (which stores a plurality of computer programs such as PROG #1 (232), PROG #2 (234) and PROD # N (236)), suitable for carrying out the various example embodiments of the present invention. A second computer-readable memory 240 stores vehicle temperature setting and other aging related data 246, and vehicle configuration setting data 244, as well as thermal management schemes 242 which can in one example embodiment be adapted to various regions of use of the one or more user equipment.

The DP 210 and PROG #1 (232) can be employed to periodically determine one or more temperature thresholds and configuration settings attributable to one or more user equipment coupled to a vehicle. The DP 310 and PROG #2 (334) can be employed to send the one or more determined temperature thresholds and configuration settings to the one or more user equipment in a thermal management scheme message. The thermal management scheme message can be shared among eNodeBs over the S1 interface 275.

Although, FIG. 2 depicts a first computer-readable memory 230 and a second computer-readable memory 240, eNB 200 may include one or more additional memories, or fewer memory units, for carrying out some example embodiments of the present invention. Moreover, the programs described above (e.g. PROG #1 (232) and PROG #2 (234)) are not limited to a specific memory location (e.g. first computer-readable memory 230 and second computer-readable memory 240). FIG. 2 merely shows one possible non-limiting example embodiment of the present invention.

eNB 200 also includes a plurality of radio access communication modules 260 and a plurality of radio access technology antennas 270. The radio access communication module 260 can be for example a Long Term Evolution/Long Term Evolution Advanced/Long Term Evolved Beyond (LTE/LTE-A/LTE-B) transceiver, or any similar transceiver. Such non-limiting examples include any other transceiver capable of communicating with a Universal Mobile Telecommunications System, an Evolved Universal Mobile Telecommunications System Terrestrial Radio Access Network, a Global System for Mobile Communications network, a Universal Terrestrial Radio Access Network, or cellular networks employing Wideband Code Division Multiple Access or High Speed Packet Access. Also, radio access communication module 260 can be a adapted to access a first responder authority network and/or public safety authority network as will be designated in the future in the United States or elsewhere.

Figure 3:
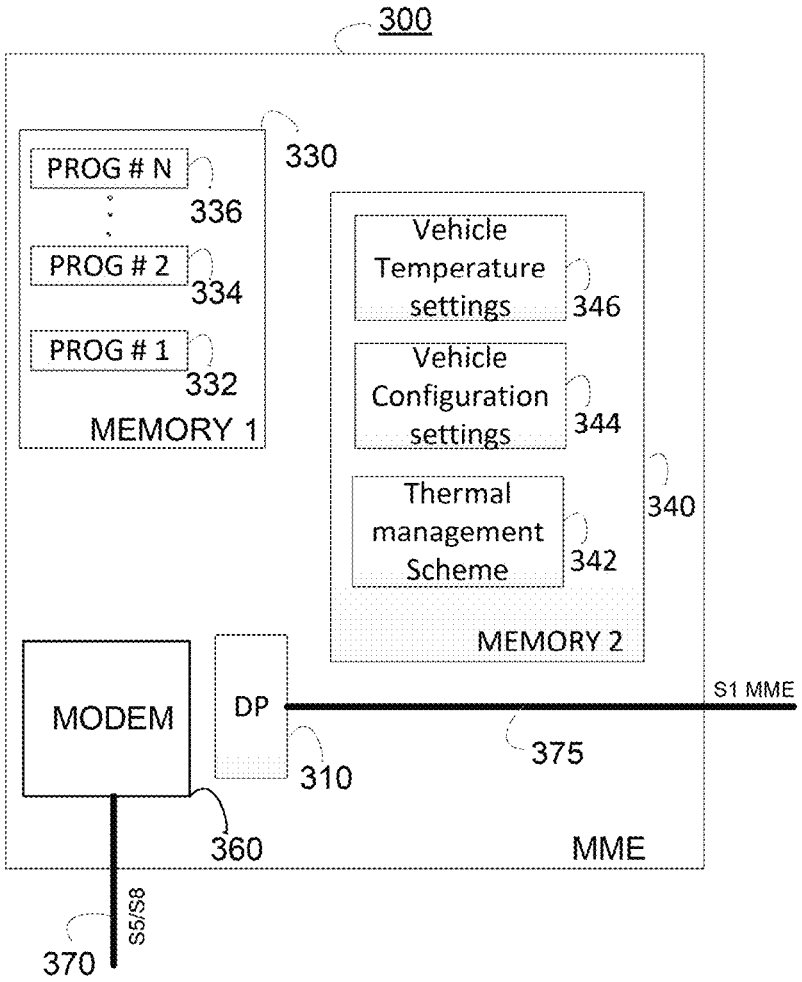
FIG. 3 shows a simplified block diagram of an example of a mobile management entity suitable for use in practicing some example embodiments of the invention.

Referring now to FIG. 3, an illustration of a simplified block diagram of an example of a mobile management entity (MME) 300 is shown for use in practicing some example embodiments of the invention. MME 300 can alternatively be adapted to provide the functionality of periodically determining one or more temperature thresholds and configuration settings attributable to one or more user equipment coupled to a vehicle as well as sending the one or more determined temperature thresholds and configuration settings to the one or more user equipment in a thermal management scheme message. Thereafter, the thermal management scheme message is merely propagated to one or more eNBs which in turn provide the message to the one or more user equipment. MME 300 can be one entity or may be one of many MMEs in a so-called MME pool (not shown).

MME 300 includes one or more processors, such as at least one data processor (DP) 310, a first computer-readable memory 330 (which stores a plurality of computer programs such as PROG #1 (332), PROG #2 (334) and PROG # N (336)), suitable for carrying out the various example embodiments of the present invention. A second computer-readable memory 340 stores vehicle temperature setting and other aging related data 346, vehicle configuration setting data 344 as well as thermal management schemes 342 which can in one example embodiment be adapted to various regions of use of the user one or more user equipment.

The DP 310 and PROG #1 (332) can be employed to periodically determine one or more temperature thresholds and configuration settings attributable to one or more user equipment coupled to a vehicle. The DP 310 and PROG #2 (334) can be employed to send the one or more determined temperature thresholds and configuration settings to the one or more user equipment in a thermal management scheme message. The thermal management scheme message can be shared among MME in a MME pool and/or eNodeBs in a tracking area over the S1 MME interface 375. Modem 360 together with S5/S8 interface allow 370 access to the packet data gateway (not shown).

Although, FIG. 3 depicts a first computer-readable memory 330 and a second computer-readable memory 340, MME 300 may include one or more additional memories, or fewer memory units, for carrying out some example embodiments of the present invention. Moreover, the programs described above (e.g. PROG #1 (332) and PROG #2 (334)) are not limited to a specific memory location (e.g. first computer-readable memory 330 and second computer-readable memory 340). FIG. 3 merely shows one possible non-limiting example embodiment of the present invention.

Figure 4:
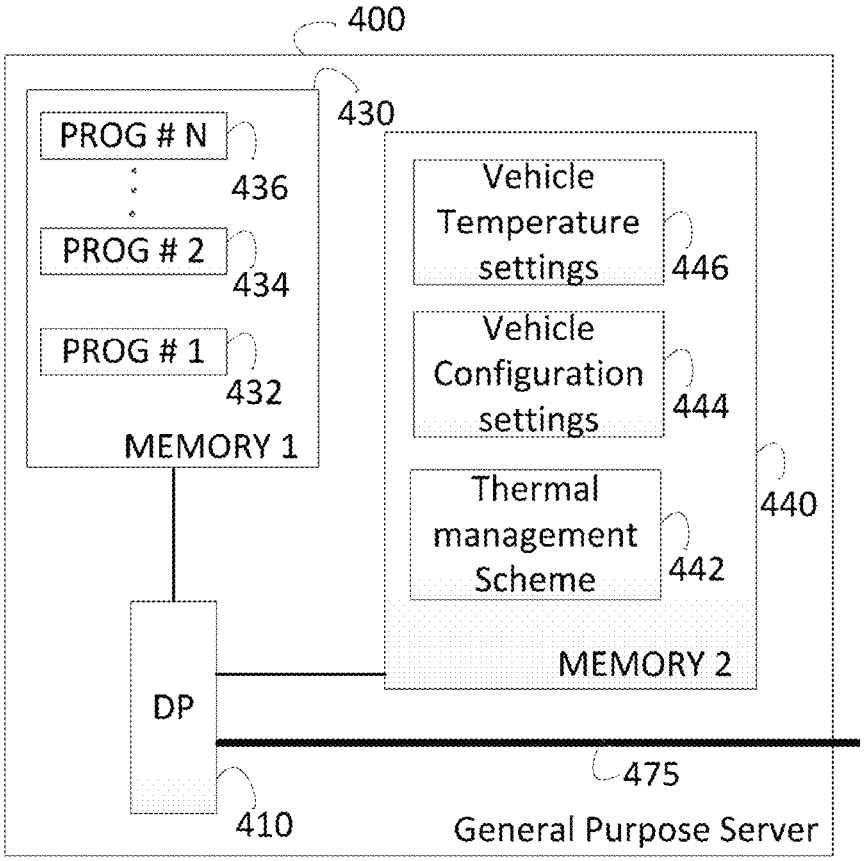
FIG. 4 shows a simplified block diagram of an example of a general purpose server suitable for use in practicing some example embodiments of the invention.

Referring now to FIG. 4, an illustration of a simplified block diagram of an example of a general purpose (GP) server 400 is shown for use in practicing some example embodiments of the invention, in another example embodiment of the present invention, GP server 400 is adapted for providing the functionality of periodically determining one or more temperature thresholds and configuration settings attributable to one or more user equipment coupled to a vehicle and sending the one or more determined temperature thresholds and configuration settings to the one or more user equipment in a thermal management scheme message. Thereafter, thermal management scheme message is transmitted over a WiFi network (not shown) by way of a communication link 475. GP server 400 can in one example embodiment be a vehicle ad hoc network (VANET) server.

GP server 400 includes one or more processors, such as at least one data processor (DP) 410, a first computer-readable memory 430 (which stores a plurality of computer programs such as PROG #1 (432), PROG #2 (434) and PROG # N (436)), suitable for carrying out the various example embodiments of the present invention. A second computer-readable memory 440, stores vehicle temperature setting and other aging related data 446, vehicle configuration setting data 444 as well as thermal management schemes 442 which can in one example embodiment be adapted to various regions of use of the user one or more user equipment.

The DP 410 and PROG #1 (432) can be employed to periodically determine one or more temperature thresholds and configuration settings attributable to one or more user equipment coupled to a vehicle. The DP 410 and PROG #2 (434) can be employed to send the one or more determined temperature thresholds and configuration settings to the one or more user equipment in a thermal management scheme message. The thermal management scheme message can be communicated for example over a vehicle area network (VANE) over communication link 475. Communication link 475 can be an RJ45 conduit or USB port which are coupled to a router or switch (not shown) or directly to an access point in a WiFi network (not shown).

Although, FIG. 4 depicts a first computer-readable memory 430 and a second computer-readable memory 440, GP server 400 may include one or more additional memories, or fewer memory units, for carrying out some example embodiments of the present invention. Moreover, the programs described above (e, g. PROG #1 (432) and PROG #2 (434)) are not limited to a specific memory location (e.g. first computer-readable memory 430 and second computer-readable memory 440). FIG. 4 merely shows one possible non-limiting example embodiment of the present invention.

Figure 5:
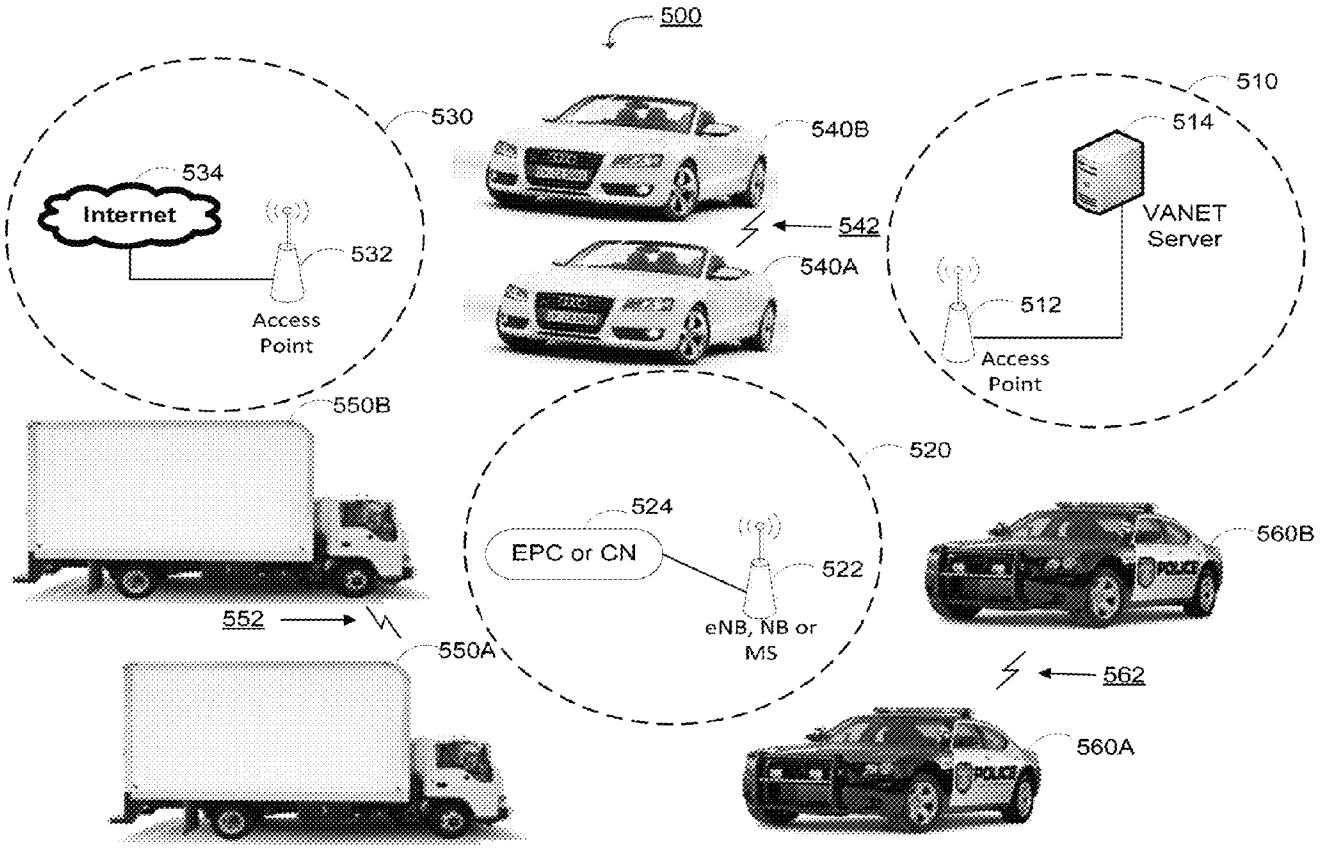
FIG. 5 illustrates schematically several example scenarios of vehicles equipped with user equipment in accordance with some example embodiments of the invention.

Referring now to FIG. 5, several example scenarios of motor vehicles equipped with user equipment 500 are schematically shown in accordance with some example embodiments of the invention. In one example embodiment of the present invention, two or more motor vehicles (e.g. 540A and 540B) can include user equipment such as that shown in FIG. 1. Similarly, a fleet of delivery type trucks or vans (e.g. 550A and 550B) can include user equipment in accordance with example embodiments of the present invention. Furthermore, as shown in FIG. 5, a fleet of first responder vehicles (e.g. 560A and 560B) can include user equipment in accordance with example embodiments of the present invention. Each motor vehicle shown in FIG. 5 may be adapted for vehicle to vehicle communication e.g. see vehicle to vehicle communication signals 542, 552 and 562).

Various radio access network technologies are available for carrying out example embodiments of the present invention. For example, as shown in FIG. 5, a wireless local area network 530 is accessible by each of the fleets of vehicles when an access point 532 is in range of each user equipment's transceiver to allow the vehicle access to the Internet 534. A vehicle ad hoc network (VANE') 510 is another wireless access network technology available for carrying out example embodiments of the present invention. A VANET can include one or more VANET servers, such as VANET server 514 and at least one access point 512. As mentioned above, various wired or galvanic communication links can be employed for the purpose of accessing VANET 510. Further, wireless interfaces such as a Bluetooth™ radio access interface (Blue radio module), a Zigbee radio interface, a radio frequency identification (RFID) interface, an IEEE 802.11e standardized radio interface, a near field communication link, or a communications access for land mobiles link, as well as other dedicated short range communications (DSRC) wireless technologies can be employed.

Other radio access network technologies that are available for carrying md example embodiments of the present invention can include 2G, 3G, a Long Term Evolution (LTE)/LTE A or a legacy cellular network. For example, an Evolved Universal Terrestrial Radio Access Network, a Universal Terrestrial Radio Access Network, a public safety network or a first responder network 520 includes an Evolved Packet Core 524 or a GSM Enhanced Data Rates for Global Evolution Radio Access Network which includes a core network (CN). An evolved Node B (eNB), Node B, mobile station or pica or femto eNB 522 or any special purpose server in the network may be accessed by vehicles having a user equipment and method and computer programs in accordance with example embodiments of the present invention.

Figure 6:
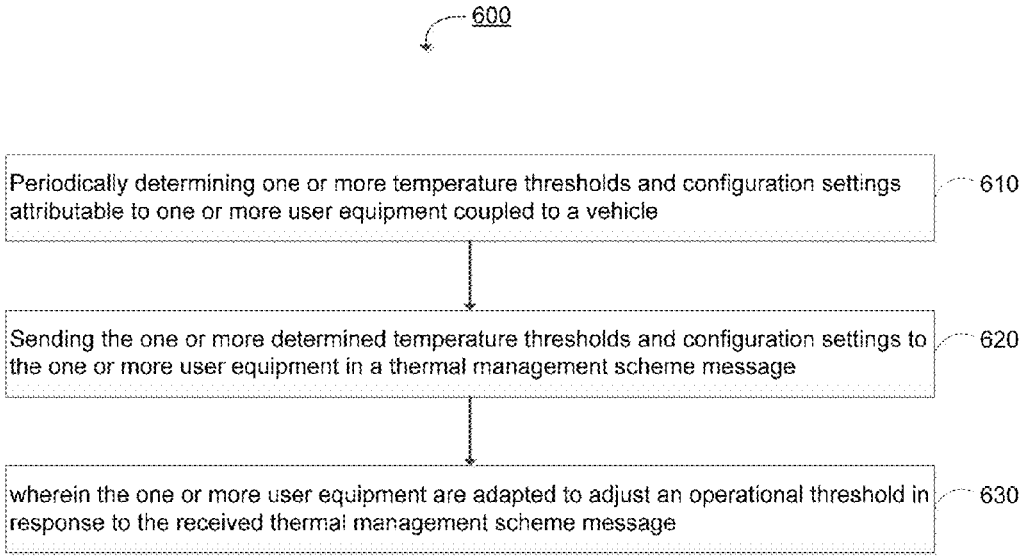
FIG. 6 shows a flow diagram of the operation of an example of a method, and a result of execution of computer program instructions embodied on a computer readable memory of a special purpose network, in accordance with some exemplary embodiments of this invention.

Referring now to FIG. 6, a flow diagram is provided to illustrate the operation of an example of a method, and a result of execution of computer program instructions embodied on a computer readable memory of a special purpose server in network or a special purpose network 300, in accordance with some exemplary embodiments of this invention.

As described above, a special purpose network, such as the three shown in FIG. 5, provide a method or computer program which periodically determines one or more temperature thresholds and configuration settings attributable to one or more user equipment coupled to a vehicle (610), and sends the one or more determined temperature thresholds and configuration settings to the one or more user equipment in a thermal management scheme message (620), wherein the one or more user equipment are adapted to adjust an operational threshold in response to the received thermal management scheme message (630).

In one example embodiment, the special purpose network or a server in the special purpose network periodically determines the one or more temperature thresholds and configuration settings and sends the thermal management scheme messages to the one or more user equipment. As shown in FIG. 2, the special purpose network can be a public safety network, a special purpose network, a vehicle ad hoc network, a Global System for Mobile Communications network (GSM), a GSM Enhanced Data Rates for Global Evolution Radio Access Network, a Universal Terrestrial Radio Access Network (UTRAN), an Evolved Universal Terrestrial Radio Access Network (eUTRAN), a first responder network (FirstNet), or cellular networks employing Wideband Code Division Multiple Access or High Speed Packet Access. The thermal data (e.g. temperature thresholds and configuration settings) of each user equipment can be stored in a special purpose server in network, in an eNB or in various logical entities in the EPC (e.g. mobile management entity MME). In an alternative embodiment, the special purpose network is a wireless local area network (WiFi).

In one example embodiment, temperature thresholds and configuration settings are determined by a field failure rate of one or more geographic areas in which the vehicle is located. In another example embodiment, the temperature thresholds and configuration settings are determined by a location where the vehicle is sold or detected to be operational after a predetermined time or predefined time intervals. Furthermore, the temperature thresholds and configuration settings are determined by comparing a current operational threshold to one or more historical operational thresholds stored in memory in the one or more user equipment.

As shown in FIG. 5, one or more user equipment can be members of a predefined group. For example, new passenger vehicles 540A, 540B equipped with user equipment can be remotely managed by their vehicle maintenance servers over the Internet, or by way of an LTE network, for example. A fleet of delivery trucks 550A, 550B can be a predefined group managed by a centralized motor pool or similar entity over the Internet, or by way of an LTE network, for example. Likewise, a fleet of first responder vehicles 560A, 260B can be a predefined group managed by a centralized motor pool or similar entity over the Internet, or by way of an LTE network (e.g. FirstNet), for example. In one example embodiment, each fleet vehicle has one or more substantially equal installation positions, substantially equal housings, substantially equal reference hardware configurations, substantially equal thermal dissipation or a substantially equal reference hardware layout.

In one possible example embodiment, the temperature thresholds and configuration settings are determined by comparing a current operational threshold or threshold limits to the rank order of a geographic area. That is, the user equipment can be adapted for changes in location of the vehicle. For example, the current operational threshold is determined by one or more sensors deployed in the user equipment or coupled to the vehicle. Moreover, the current operational threshold can be determined by installation position of user equipment coupled to the vehicle. Another possible embodiment can provide that the current aging scenario is determined by availability of airflow in the one or more user equipment.

As mentioned above and shown in FIG. 1, in one example the one or more sensors include a temperature sensor, an environmental sensor, a pressure sensor and a proximity sensor. Moreover, the environmental sensor in one example includes sensors for humidity, vibration, speed, precipitation, salinity, acceleration, sunlight, air flow or any other special purpose sensor.

In one possible example embodiment, the temperature thresholds and configuration settings are determined by comparing a current aging scenario to a predetermined component aging scenario attributable to the one or more user equipment. The one or more user equipment are members of a predefined group, as described above.

In yet another possible example embodiment, one or more aging circuits, position sensors and heat dissipation hot spot detectors are proximately located to the one or more user equipment as shown, for example, in FIG. 1. The current aging scenario is determined by an aging circuit in the one or more user equipment. In another possible example embodiment, the current aging scenario is determined by installation position in the one or more user equipment. In yet another embodiment, the current aging scenario is determined by availability of airflow in the one or more user equipment. In a further embodiment, current aging scenario is defined according to one or more automatic frequency error (AFC) predefined thresholds.

In one possible example embodiment, adjusting the operational threshold of the one or more user equipment includes triggering at least one cooling fan and throttling a processor adapted for controlling the one or more user equipment. Alternatively, another example embodiment provides that the operational threshold is adjusted upon initialization of the one or more user equipment, or upon a connection to a core network, at a periodic interval, or according to a predefined cumulative aging criteria, or upon exceeding a predefined operational limit, or upon exceeding a predefined automatic frequency control threshold. Another example embodiment provides that the operational threshold is adjusted after altering of the operational geographic area is detected. In yet another embodiment, the communication power class, additional maximum power relaxation (AMPR), data class and/or communication MIMO class is adjusted according to predefined criteria or threshold.

In one example embodiment the one or more user equipment are adapted to operate in one or more operational modes, including a limiting mode, a normal mode, emergency mode and boosting mode, wherein each one or more operational Modes controls an operation of the one or more fans and the speed of the processor, predefined power levels, uplink data speed, power class, additional maximum power relaxation (AMPR), downlink data speed, and number of communication links, communication data class and/or MIMO class. A user or a network operator selects from among the one or more operational modes. The one or more operational modes are adapted for seasonal changes in the geographic location. In some example embodiments, if a user equipment coupled to a vehicle detects that the current geographic location (e.g. detected for example by way of GPS RF circuit 168 or network positioning in FIG. 1), the current calendar date and one or more predefined related regional environmental conditions do not match (e.g. if the vehicle is used in a mine) the user equipment will request regional environmental condition parameters that match the current GPS coordinates and calendar date. As described above, the regional environmental conditions are stored in one or more memories in the user equipment, or the access point (e.g. eNB), or a mobile management entity (MME), or a general purpose server. The regional environmental conditions can be nominal values or extreme environmental values adapted from a table in memory. Nominal values may be used when the vehicle is observed to be in conditions that match predefined values.

In one example embodiment, the thermal management scheme message is transmitted and/or received over a Global System for Mobile Communications network, an Evolved Universal Terrestrial Radio Access Network, a Universal Mobile Telecommunications System Terrestrial Radio Access Network, a GSM Enhanced Data Rates for Global Evolution Radio Access Network, a public safety network or a first responder network. The thermal management scheme message may be transmitted and/or received over a wired or wireless short range communication link including a. Bluetooth™ radio access interface, a Zigbee radio interface, a radio frequency identification interface, a wireless local area network computer, a near field communication link, or a communications access for land mobiles link.

Figure 7:
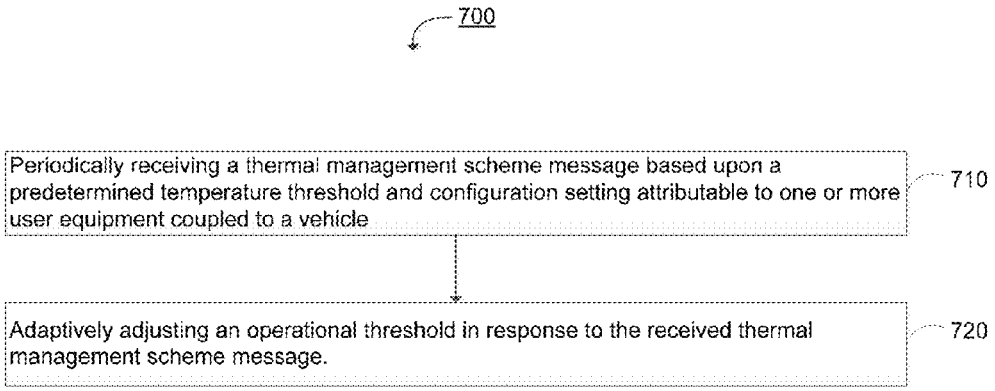
FIG. 7 shows a flow diagram of the operation of an example of a method, and a result of execution of computer program instructions embodied on a computer readable memory of a user equipment couple to a vehicle, in accordance with some exemplary embodiments of this invention.

Referring now to FIG. 7 a flow diagram is provided to illustrate the operation of a method, and a result of execution of computer program instructions embodied on a computer readable memory of a user equipment 400, in accordance with some exemplary embodiments of this invention. The method and computer program provide a method including periodically receiving a thermal management scheme message based upon a predetermined temperature threshold and configuration setting attributable to one or more user equipment coupled to a vehicle (710) and adaptively adjusting art operational threshold or group of threshold limits in response to the received thermal management scheme message (720).

In these regards, the non-limiting example embodiments of this invention may be implemented at least in part by computer software stored on the non-transitory memory which is executable by a processor, or by hardware, or by a combination of tangibly stored software and hardware (and tangibly stored firmware). Electronic devices implementing these aspects of the invention need not be the entire devices as depicted at FIGS. 2 to 4, but example embodiments may be implemented by one or more components of the same, such as the above-described tangibly stored software, hardware, firmware and processor or micro-controllers, or a system on a chip (SOC), Modern on Module (MoM), System in Package (SIP) or an application specific integrated circuit (ASIC).

Various embodiments of the computer readable memory such as those disclosed in FIG. 1 to 4 include any data storage technology type that is suitable to the local technical environment, including, but not limited to, semiconductor based memory devices, magnetic memory devices and systems, optical memory devices and systems, fixed memory, removable memory, disc memory, flash memory, DRAM, SRAM, EEPROM and the like. Various embodiments of the data processors include, but are not limited to, general purpose computers, special purpose computers, microprocessors, digital signal processors (DSPs) and multi-core processors.

As used in this application, the term "circuitry" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or other user equipment or a server, to perform various functions and (c) to circuits, such as a microprocessor(s) or a portion of a microprocessor(s), that require software or firmware for operation, even if the software or firmware is not physically present. This definition of "circuitry" applies to all uses of this term in this specification, including in any claims. As a further example, as used in this application, the term "circuitry" would also cover an implementation of merely a processor (or multiple processors) or portion of a processor and its (or their) accompanying software and/or firmware. The term "circuitry" would also cover, for example, and if applicable to the particular claim element, a baseband integrated circuit or applications specific integrated circuit for a mobile phone or other UE or a similar integrated circuit in server, a cellular network device, or other network device. The reference throughout this disclosure to a UE may be embodied in a motor vehicle's telematics console, on board diagnostic (OBD) interface, ceiling or steering wheel assembly, among other internal cabin locations in a car, truck, van, bus or other motorized vehicle. Alternatively, a UE can be embodied on a cellular phone, a personal digital assistant (PDA), a wireless modem, a wireless communication device, a laptop, a netbook, a tablet or any other device cable of communicating with a FirstNet, E-UTRAN, UTRAN or GERAN enabled device.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A method comprising:

periodically determining, by a network device, one or more temperature thresholds and configuration settings to apply to one or more wireless equipment coupled to a vehicle, according to a determination by the network device of an installation position of the one or more wireless equipment on or within the vehicle; and causing the one or more wireless equipment to implement a change in operation in the one or more wireless equipment in response to a first criteria indicated by a thermal management scheme message, the causing comprising sending, by the network device, the one or more determined temperature thresholds and configuration settings to the one or more wireless equipment in the thermal management scheme message, the thermal management scheme message indicating the first criteria as a trigger for the one or more wireless equipment to implement the change in operation to control heat generation.

2. The method according to claim 1, wherein at least one of:

the temperature thresholds and configuration settings are determined by a location where the vehicle is sold or detected to be operational after a predetermined time or at predetermined time intervals, the one or more wireless equipment are members of a predefined group, and the temperature thresholds and configuration settings are determined by comparing a current aging scenario to a predetermined component aging scenario attributable to the one or more wireless equipment.

3. The method according to claim 1, wherein the one or more temperature thresholds and configuration settings are determined according to detection of proximity to a first location on or within the vehicle relative to where the one or more wireless equipment reside, and an environmental condition corresponding to the first location.

4. An apparatus for use in a special purpose network, the apparatus being arranged to at least:

periodically determine, by a network device, one or more temperature thresholds and configuration settings to apply to one or more wireless equipment coupled to a vehicle, according to a determination by the network device of, an installation position of the one or more wireless equipment on or within the vehicle; and cause the one or more wireless equipment to implement a change in operation in the one or more wireless equipment in response to a first criteria indicated by a thermal management scheme message, comprising to send, at the network device, the one or more determined temperature thresholds and configuration settings to the one or more wireless equipment in the thermal management scheme message, the thermal management scheme message indicating the first criteria as a trigger for the one or more wireless equipment to implement the change in operation to control heat generation.

5. The apparatus according to claim 4, wherein the temperature thresholds and configuration settings are determined by a location where the vehicle is sold or detected to be operational after a predetermined time or at a predetermined time intervals, or the temperature thresholds and configuration settings are determined by comparing a current aging scenario to a predetermined component aging scenario attributable to the one or more wireless equipment.

6. The apparatus according to claim 4, wherein the thermal management scheme message is at least one of transmitted or received over at least one of:

a) an Evolved Universal Terrestrial Radio Access Network, a Universal Terrestrial Radio Access Network, a GSM Enhanced Data Rates for Global Evolution Radio Access Network, a public safety network, or a first responder network, and b) a wired or a wireless short range communication link comprising at least one of:
a Bluetooth™ radio access interface;
a Zigbee radio interface;
a radio frequency identification interface;
a wireless local area network computer;
a near field communication link; or
a communications access for land mobiles link.

7. A computer program product comprising a non-transitory computer readable medium having computer coded instructions stored therein which when executed by a processor causing performance of operations, said operations comprising:

periodically determining, by a network device, one or more temperature thresholds and configuration settings attributable to one or more wireless equipment coupled to a vehicle, according to a determination by the network device of, an installation position of the one or more wireless equipment on or within the vehicle; and causing the one or more wireless equipment to implement a change in operation in the one or more wireless equipment in response to a first criteria indicated by a thermal management scheme message, the causing comprising sending, by the network device, the one or more determined temperature thresholds and configuration settings to the one or more wireless equipment in the thermal management scheme message, the thermal management scheme message indicating the first criteria as a trigger for the one or more wireless equipment to implement the change in operation to control heat generation.

8. The computer program product according to claim 7, wherein at least one of:

at least one of a special purpose network or server periodically determines the one or more temperature thresholds and configuration settings and sends the thermal management scheme message to the one or more wireless equipment, the temperature thresholds and configuration settings are determined by a location where the vehicle is sold or detected to be operational after a predetermined time or at predetermined time intervals, or the temperature thresholds and configuration settings are determined by comparing a current aging scenario to a predetermined component aging scenario attributable to the one or more wireless equipment.

9. The computer program product according to claim 7, wherein the thermal management scheme message is at least one of transmitted or received over at least one of:

a) an Evolved Universal Terrestrial Radio Access Network, a Universal Terrestrial Radio Access Network, a GSM Enhanced Data Rates for Global Evolution Radio Access Network, a public safety network, or a first responder network, and b) a wired or a wireless short range communication link comprising at least one of:
a Bluetooth™ radio access interface;
a Zigbee radio interface;
a radio frequency identification interface;
a wireless local area network computer;
a near field communication link; or
a communications access for land mobiles link.

10. A method comprising:

periodically receiving, by one or more wireless equipment coupled to a vehicle, a thermal management scheme message from a network device based upon a predetermined temperature threshold and configuration setting to apply to the one or more wireless equipment, the thermal management scheme message indicating a first criteria as a trigger for the one or more wireless equipment to implement a change in operation to control heat generation, the thermal management scheme message determined according to a determination by the network device of an installation position of the one or more wireless equipment on or within the vehicle; and adaptively implementing the change in operation in the one or more wireless equipment in response to the first criteria indicated by the received thermal management scheme message.

11. The method according to claim 10, wherein:

the temperature thresholds and configuration settings are determined by comparing a current operational threshold to one or more historical operational thresholds stored in memory in the one or more wireless equipment, wherein an operational threshold comprises a criteria or threshold as a trigger for the one or more wireless equipment to implement a change in operation to control heat generation.

12. The method according to claim 10, wherein implementing the change in operation in response to the first criteria or threshold comprises one or more of:

altering a data class of the one or more wireless equipment;

altering power class of the one or more wireless equipment;

altering additional maximum power relaxation of the one or more wireless equipment; and altering multiple input multiple output class of the one or more wireless equipment.

13. An apparatus, the apparatus configured to at least:

periodically receive, in one or more wireless equipment coupled to a vehicle, from a network device, a thermal management scheme message comprising a temperature threshold and configuration setting to apply to the one or more wireless equipment, the temperature threshold and configuration setting determined according to a determination by the network device of an installation position of the one or more wireless equipment on or within the vehicle, the thermal management scheme message indicating a first criteria as a trigger for the one or more wireless equipment to implement a change in operation in the one or more wireless equipment to control heat generation; and adaptively implement the change in operation in response to the first criteria indicated by the received thermal management scheme message.

14. The apparatus according to claim 13, wherein at least one of:

the temperature thresholds and configuration settings are determined by comparing a current operational threshold to one or more historical operational thresholds stored in memory in the one or more wireless equipment, wherein an operational threshold comprises a criteria or threshold as a trigger for the one or more wireless equipment to implement a change in operation to control heat generation, one or more aging circuits, position sensors and heat dissipation hot spot detectors are proximately located to the one or more wireless equipment, and a current aging scenario is determined by an aging circuit in the one or more wireless equipment.

15. The apparatus according to claim 13, wherein implementing the change in operation in response to the first criteria or threshold comprises at least one of:

altering a data class of the one or more wireless equipment;

altering power class of the one or more wireless equipment;

altering additional maximum power relaxation of the one or more wireless equipment; and altering multiple input multiple output class of the one or more wireless equipment.

16. The apparatus according to claim 13, wherein the thermal management scheme message is at least one of transmitted or received over at least one of:

a) an Evolved Universal Terrestrial Radio Access Network, a Universal Terrestrial Radio Access Network, a GSM Enhanced Data Rates for Global Evolution Radio Access Network, a public safety network, or a first responder network, and b) a wired or a wireless short range communication link comprising at least one of:

a Bluetooth™ radio access interface;

a Zigbee radio interface;

a radio frequency identification interface;

a wireless local area network computer;

near field communication link; or a communications access for land mobiles link.

17. A computer program product comprising a non-transitory computer readable medium having computer coded instructions stored therein, said instructions causing performance of operations, said operations comprising:

periodically receiving, in one or more wireless equipment coupled to a vehicle, from a network device, a thermal management scheme message comprising a temperature threshold and configuration setting attributable to the one or more wireless equipment, the temperature threshold and configuration setting determined according to a determination by the network device of an installation position of the one or more wireless equipment on or within the vehicle; and adaptively implementing the change in operation in the one or more wireless equipment in response to a first criteria indicated by the received thermal management scheme message.

18. The computer program product according to claim 17, wherein at least one of:

the temperature thresholds and configuration settings are determined by comparing a current operational threshold to one or more historical operational thresholds stored in memory in the one or more wireless equipment, wherein an operational threshold comprises a criteria or threshold as a trigger for the one or more wireless equipment to implement a change in operation to control heat generation; or a current aging scenario is determined by an aging circuit in the one or more wireless equipment.

19. The computer program product according to claim 17, wherein implementing the change in operation in response to the first criteria comprises at least one of:

altering a data class of the one or more wireless equipment;

altering power class of the one or more wireless equipment;

altering additional maximum power relaxation of the one or more wireless equipment; and altering multiple input multiple output class of the one or more wireless equipment.

20. The computer program product according to claim 17, wherein the thermal management scheme message is at least one of transmitted or received over at least one of:

a) an Evolved Universal Terrestrial Radio Access Network, a Universal Terrestrial Radio Access Network, a GSM Enhanced Data Rates for Global Evolution Radio Access Network, a public safety network, or a first responder network, and b) a wired or a wireless short range communication link comprising at least one of:

a Bluetooth™ radio access interface;

a Zigbee radio interface;

a radio frequency identification interface;

a wireless local area network computer;

a near field communication link; or a communications access for land mobiles link.

* * * * *